US005224885A

United States Patent [19]

Youngfleish

[11] Patent Number: 5,224,885

[45] Date of Patent: Jul. 6, 1993

[54] LOW PROFILE DUAL BEAM CONTACT

[75] Inventor: Frank C. Youngfleish, Penna Furnace, Pa.

[73] Assignee: Elco Corporation, Huntingdon, Pa.

[21] Appl. No.: 881,748

[22] Filed: May 5, 1992

[51] Int. Cl.[5] ..... H01R 13/00

[52] U.S. Cl. ..... 439/861

[58] Field of Search ..... 439/842, 844, 851, 852, 439/853, 854, 855, 856, 857

[56] References Cited

U.S. PATENT DOCUMENTS

| | | | |
|---|---|---|---|
| 2,157,188 | 5/1939 | Robinson . | |
| 2,734,179 | 2/1956 | Levenson . | |
| 2,890,436 | 6/1959 | Bentley . | |
| 3,118,998 | 1/1964 | Mastney et al. | 439/861 |
| 3,196,377 | 7/1965 | Minich | 439/861 |
| 3,237,145 | 2/1966 | Smith . | |
| 4,795,379 | 1/1989 | Sasaki et al. | 439/862 |

*Primary Examiner*—Joseph H. McGlynn

*Attorney, Agent, or Firm*—Spensley Horn Jubas & Lubitz

[57] ABSTRACT

A low-profile dual-beam female electrical connector contact for electrically interconnecting components of an electrical system. The contact includes a contact body, cantilevered contact beams, retention flanges, and a solder tail. The contact body is a generally rectangular-shaped structure. Lateral extensions near the middle of the body attach the contact beams to the body. Each contact is generally rectangular and extends from the point of attachment toward the distal end of, and parallel to, the contact body. The retention flanges are located near the distal end of the contact body, and extend from edges thereof. Since the contact beams and the retention flanges are contained within the height of the contact body, the overall height of the contact is reduced.

8 Claims, 6 Drawing Sheets

FIG. 6
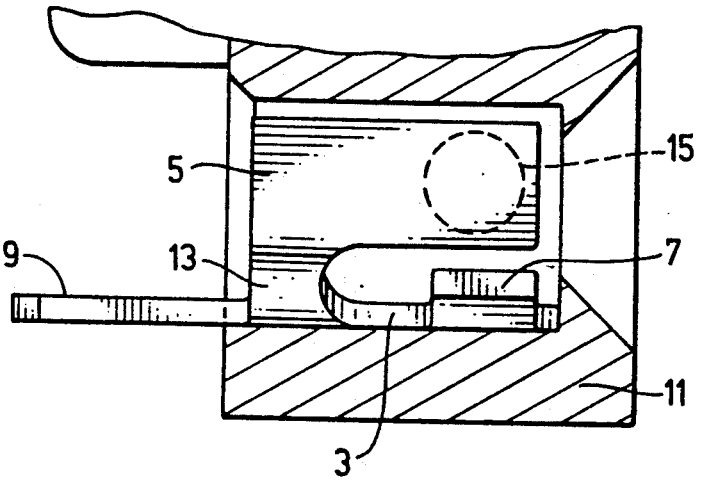
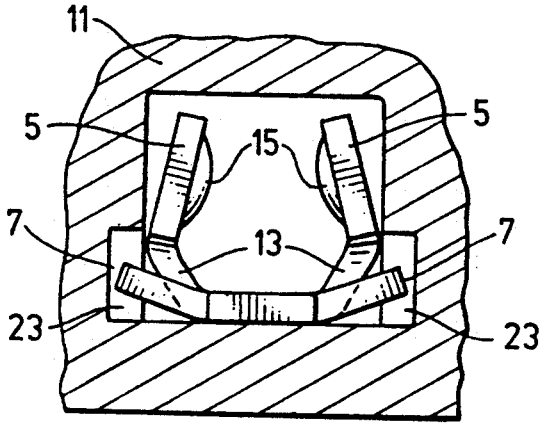
FIG. 7
FIG. 8
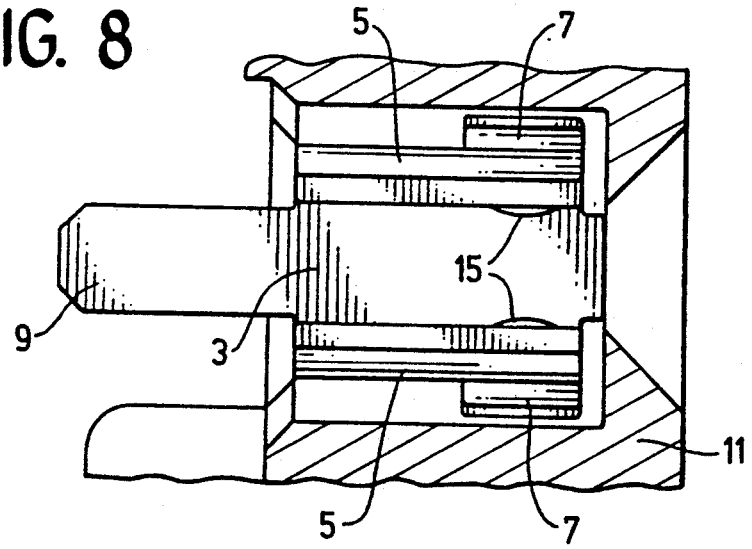

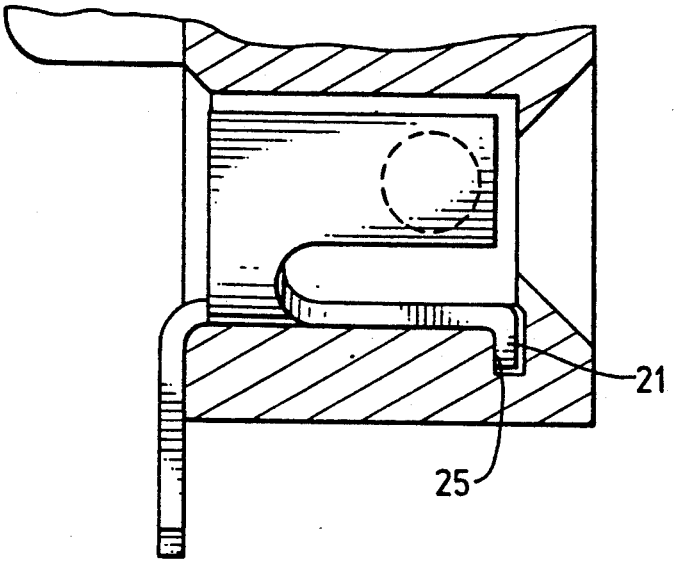
FIG. 9
FIG. 10
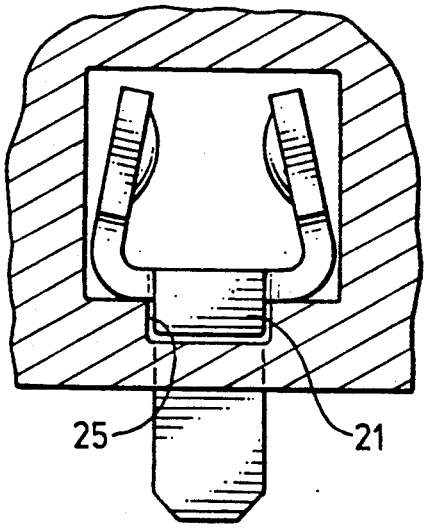
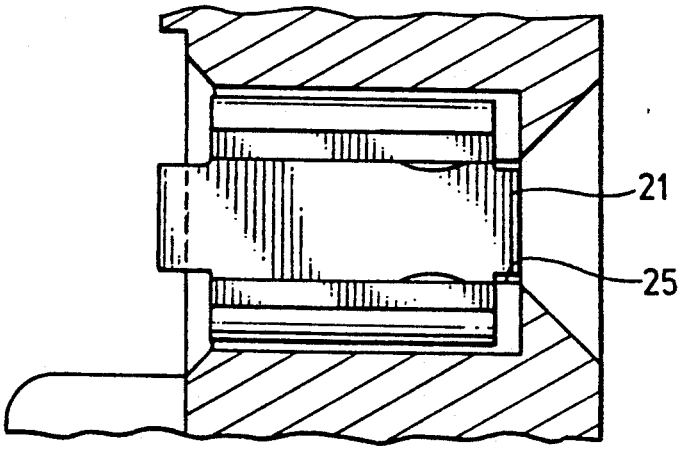
FIG. 11

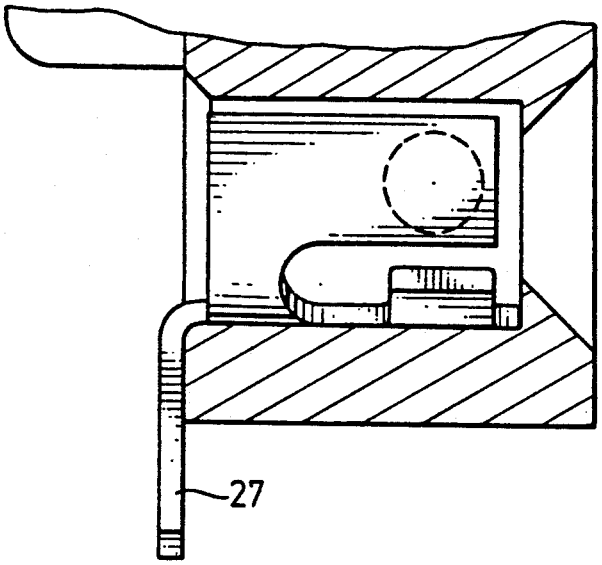
FIG. 12
FIG. 13
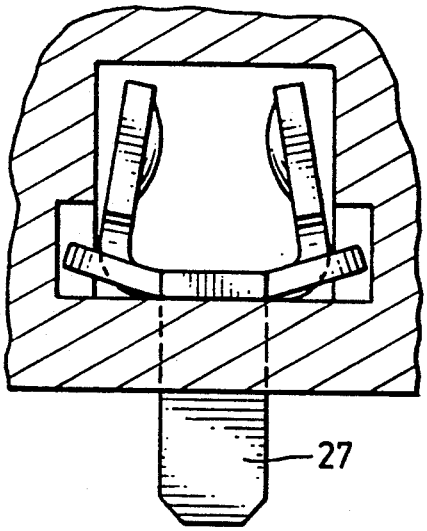
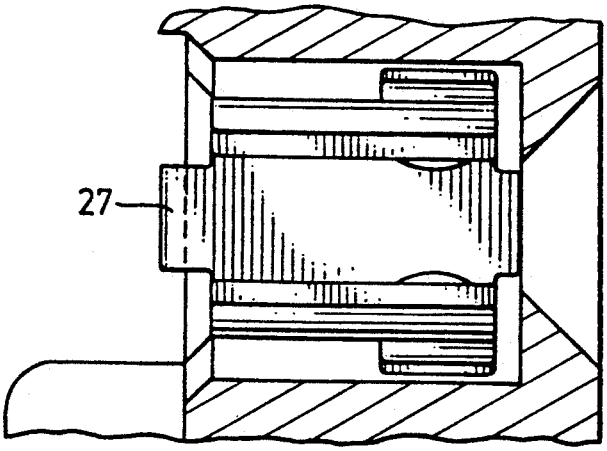
FIG. 14

LOW PROFILE DUAL BEAM CONTACT

BACKGROUND OF THE INVENTION

1. Field of the Invention

This invention relates to an electrical connector contact for electrically interconnecting electronic components, and more particularly to a low-profile, dual-beam female electrical connector contact which requires minimal space and provides maximum mating contact force upon mating with a male connector contact.

2. Description of Related Art

In almost every electronic and electrical context it is necessary to electrically interconnect electronic components. A very wide variety of electrical connectors have been designed for this purpose. In many of these designs, the connector assembly consists of a male connector and a female connector. In such designs, the male connector includes an insulating housing that secures a plurality of pins in place and the female connector includes an insulating housing which secures female connector contacts in alignment with corresponding pins of the male connector. Each female connector contact is formed from an electrically conductive material, such as copper. Such contacts are often stamped from a sheet of conductive material and folded to accept a male pin.

It is necessary for such female contacts to provide a secure mechanical contact with a male pin which is mated to the female contact. For this purpose, some contacts are fashioned with cantilevered contact beams that flex outward as the male pin is mated with the contact. The spring tension of the contact beam provides a mechanical force against the pin needed to create an electrical contact between the pin and the contact.

An example of a female connector contact having contact beams to provide a mechanical force against a mating pin is U.S. Pat. No. 2,734,179 issued to R. S. Levenson. Levenson discloses a Connection Block for an Electromagnetic Polar Relay in which a female contact 53 has three spring fingers 54, 55, 56 (or contact beams), each of which present a separate contacting surface upon engagement with a mating pin. The fingers flex outward as the mating pin engages the contacting surface of each finger. A cutout 62 locks the contact into a housing 39.

Another example of a female connector contact having contact beams to provide a mechanical force against a mating pin is U.S. Pat. application Ser. No. 07/677,778 of McClune, assigned to Elco Corporation. FIG. 1 illustrates the McClune contact. The McClune contact has two distinct regions defined as a retention region 109, and a mating region 110. These two regions of the contact are separated by slots 111, 112 which permit outward flexing of contact beams 101, 103 when a pin 113 is inserted into the contact. FIG. 2*a* and 2*b* illustrate this flexing motion.

As the need to reduce the size of electronic components has increased, so has the need to reduce the size of the connector assemblies. A limiting factor in the construction of miniature connector assemblies has been the size of the female contacts. It is also necessary in some applications for a pin to enter a female connector from the bottom of the housing. Contacts such as the Levenson contact require three distinct regions along the length of the contact: a contact beam region, a retention region, and a body region. Therefore the total height of the contact is the sum of the height of the body, the contact beam, and the retention regions. Furthermore, Levenson only permits a pin to enter from the top of a connector. McClune permits a pin to enter from the bottom of the connector but, requires a contact beam region, a retention region, and a body region.

Therefore, it is desirable to create an electrical connector contact in which each component region does not add additional length to the connector contact and which allows a male mating pin to enter from the bottom of the connector. The present invention provides such an electrical connector contact.

SUMMARY OF THE INVENTION

The present invention is a low-profile, dual-beam female electrical connector contact for electrically interconnecting components of an electrical system. The contact includes a compact body, cantilevered contact beams, retention flanges, and a solder tail.

The contact body is a generally rectangular-shaped structure. Lateral extensions near the middle of the body attach the contact beams to the body. Each contact beam is generally rectangular and extends from the point of attachment toward the distal end of, and parallel to, the contact body. The contact beams each have a protuberant convex contact pad that ensures a consistent contact force is applied to a pin by the contact beam as the pin is inserted into the contact. The retention flanges are located near the distal end of the contact body, and extend from edges thereof.

The contact beams flex outward from the central axis of the contact when a pin mates with the contact. Each contact rotates about two perpendicular axes as it spreads to allow the pin to enter. The spring tension of the conductive material of which the contact is fabricated creates torsional forces that resist the rotation and which attempt to return the contact beams to the position they maintained before the pin was inserted. These forces are translated down the contact beam to the contact pad, resulting in a contact force applied normal to the pin by the contact pad. The force so applied is sufficient to create a very low resistance to the flow of electrical current between the contact beam and the pin.

The solder tail comprises the end of the contact body proximal to the region at which the contact beams are attached. When the contact is placed into a housing of a female connector and mounted to an electronic component (such as a printed circuit board), the solder tail protrudes from the housing and allows the contact to be electrically coupled to the component upon which the connector is mounted.

Since the contact beams and the retention flanges are contained within the height of the contact body, the overall height of the contact is reduced.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

FIG. 6 is a side plan view of the present invention as installed in a housing.

FIG. 7 is a front plan view of the present invention as installed in a housing.

FIG. 8 is a top plan view of the present invention as installed in a housing.

FIG. 9 is a side plan view of a first alternative embodiment of the present invention having an L-shaped retention flange as installed in a housing.

FIG. 10 is a front plan view of a first alternative embodiment of the present having an L-shaped retention flange invention as installed in a housing.

FIG. 11 is a top plan view of a first alternative embodiment of the present invention having an L-shaped retention flange as installed in a housing.

FIG. 12 is a side plan view of a second alternative embodiment of the present invention with a solder tail bent 90° with respect to the length of the inventive contact as installed in a housing.

FIG. 13 is a top plan view of a second alternative embodiment of the present invention with a solder tail bent 90° with respect to the length of the inventive contact as installed in a housing.

FIG. 14 is a front plan view of a second alternative embodiment of the present invention with a solder tail bent 90° with respect to the length of the inventive contact as installed in a housing.

Like reference numbers and designations in the various drawings refer to like elements.

DETAILED DESCRIPTION OF THE INVENTION

Figure 1:
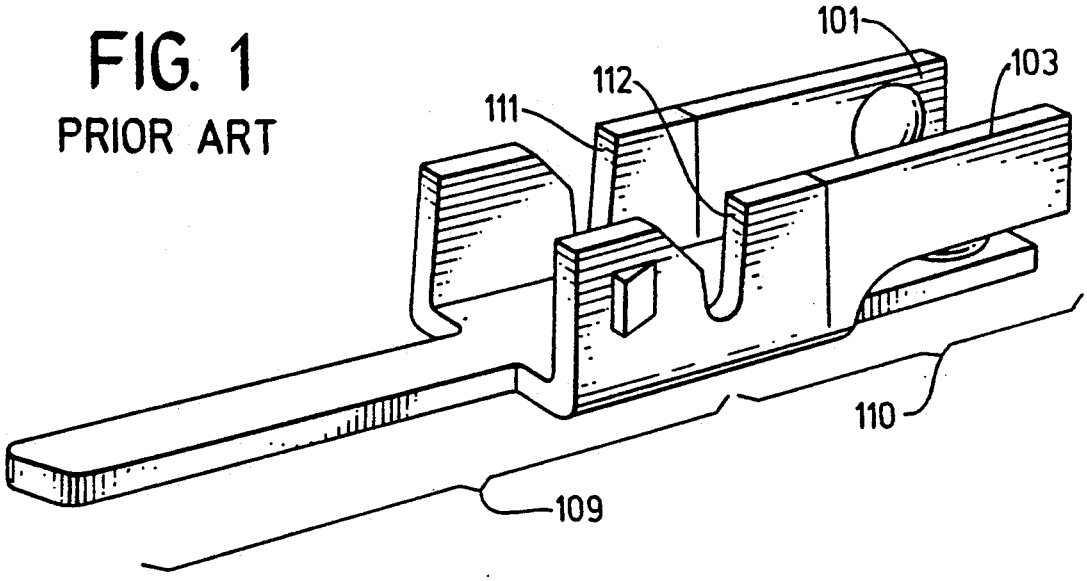
FIG. 1 PRIOR ART
FIG. 1 is a perspective view of a prior art contact.
Figure 2A:
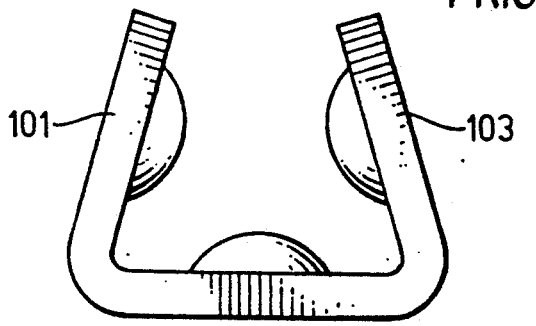
FIG. 2a PRIOR ART
FIG. 2*a* is a side view of a prior art contact.
Figure 2B:
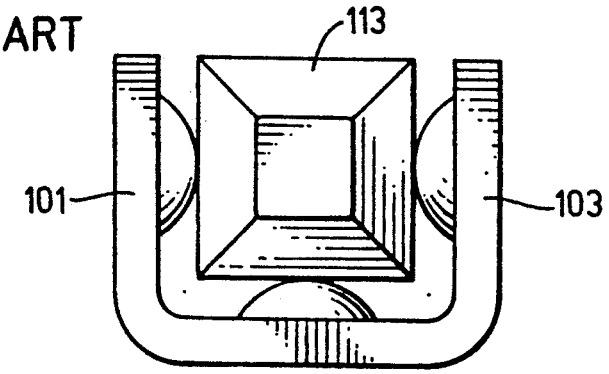
FIG. 2b PRIOR ART
FIG. 2*b* is a side view of a prior art contact with a pin inserted therein.
Figure 3:
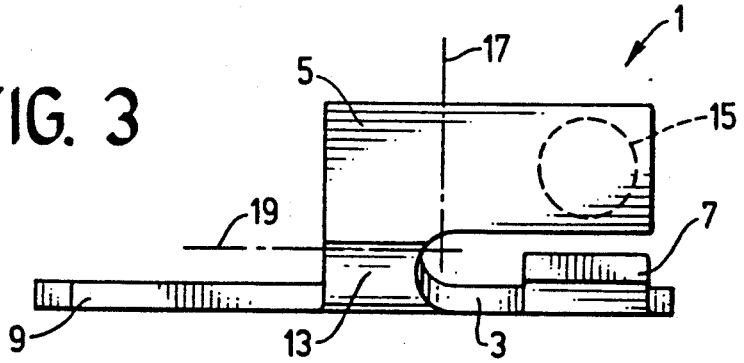
FIG. 3 is a side plan view of the present invention.
Figure 3A:
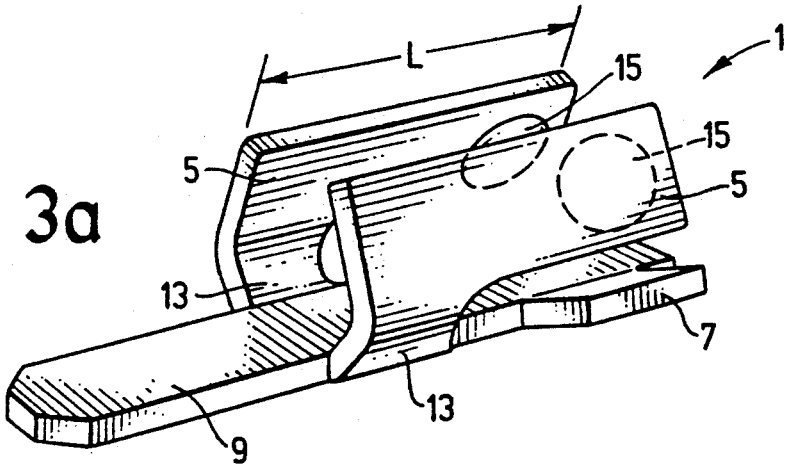
FIG. 3a is a perspective view of the present invention.
Figure 4:
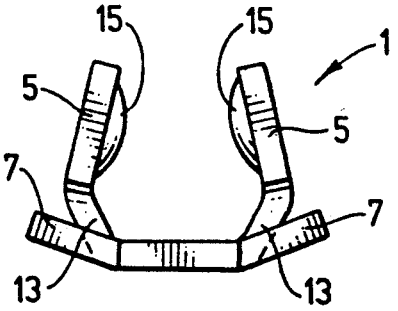
FIG. 4 is a front plan view of the present invention.
Figure 5:
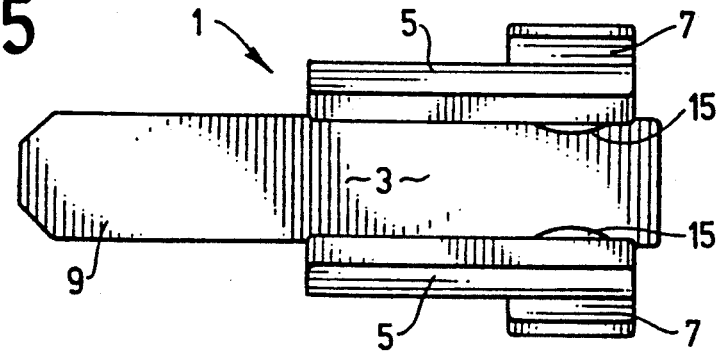
FIG. 5 is a top plan view of the present invention.

Throughout this description, the preferred embodiment and examples shown should be considered as exemplars, rather than as limitations on the present invention.

The preferred embodiment of the present invention, shown in FIGS. 3–8, is a dual beam contact 1 including a body 3, two cantilevered contact beams 5, two retention flanges 7, and a solder tail 9. Typically, a plurality of inventive contacts are installed in a housing 11 (see FIGS. 6–8). The housing 11 serves to add structural integrity to the contacts 1, protect the contacts 1 from impact with objects that could be damaging, locate the contacts 1 with respect to one another, and guide male mating pins (not shown) into the contacts 1, thereby preventing damage to the contacts 1 from such pins.

The contact body 3 is a generally rectangular structure. Near the middle region of the body are two lateral extensions 13 that bend inward at angles greater than 90° from the body. One contact beam 5 is attached to each extension 13. Each contact beam 5 extends from the corresponding extension 13 in a direction parallel to the length of the body 3 and toward the distal end thereof. In an alternative embodiment, the lateral extensions 13 are not bent. Instead, the contact beams are bent at a right angle with respect to the lateral extensions 13.

The contact beams 5 are also generally rectangular structures. Contact pads 15 are located near the distal end of the contact beams 5. The contact pads 15 are protuberant convex structures that are essentially the only points of contact between the contact 1 and an inserted pin. Thus, as a pin is inserted past the length of the contact beams 5, the surface area of the contact 1 that is in contact with the pin will remain relatively constant, thereby keeping the force required to insert the pin relatively constant as well.

The retention flanges 7 are located near the distal end of the body 3 and extend from the edges thereof. Recesses 23 in the housing 11 are provided into which the retention flanges 7 are received. When the contact 1 is placed into the housing 11, the retention flanges 7 are flexed inward. When the contact 1 is properly aligned within the housing 11, the retention flanges 7 spring outward into the recesses 23, securing the contact 1 in place. Alternative retention means for securing the contact in the housing include means such as folded or bent tabs at or near the distal end of the body.

The solder tail 9 extends from the end of the body 3 proximal to the region at which the contact beams 5 are attached. When the contact 1 is inserted in the housing 11, the solder tail 9 extends from the housing 11 to permit an electrical connection to be made between the contact 1 and an electronic component to which the contact 1 is to be mounted. The solder tail 9 is preferably tapered at the free end to facilitate penetration into a mounting hole in the electronic component.

When a pin is inserted into the contact 1, each contact beam 5 rotates about two axes. Since both contact beams are identical, for clarity, a description of the motion of only one follows. The first axis 17 (see FIG. 3) is coincident with the line of attachment between the contact beam 5 and the lateral extension 13. The second axis 19 is perpendicular to the first axis, parallel to the length of the body 3, and perpendicular to the lateral extension 13. A torsional force is created as the contact beam 5 is rotated about each axis. Each torsional force is translated down the length of the contact beam 5 to the apex of the contact pad 15 which touches the mating pin. The force is normal to the mating pin and ensures a very low resistance to the flow of electrical current between the contact 1 and the pin. Pending U.S. application Ser. No. 07/677,778 discloses contact beams which have similar motion and is herein incorporated by reference.

Referring to FIGS. 3–8, it should be obvious that the mating pin may be inserted from either the top or the bottom of a connector that uses the inventive contact.

It should be understood that the present invention is a significant improvement over the prior art in that the contact beams 5 are vertically aligned with the retention flanges 7 and the body 3. Therefore, the contact beams 5, the retention flanges, and the body are all contained within approximately the same height (i.e., length "L" defined by the length of the body without including the solder tail), thereby providing a contact that has a very low profile when mounted on an electronic component, such as a printed circuit board.

In an alternative embodiment, shown in FIGS. 9–11, a retention flange 21 is created as an L-shaped protrusion at the distal end of the contact body 3. The body 3 flexes inward as the contact is inserted into the housing 11, creating a spring tension which forces the retention flange 21 into a recess 25 in the housing 11 formed to receive the flange 21.

In another alternative embodiment, shown in FIGS. 9–14, the solder tail 27 is bent at a right angle to the contact body 3 to permit the contact 1 to be mounted on an electronic component so as to accept a mating pin inserted horizontally (parallel to the mounting surface of the component).

Figure 15:
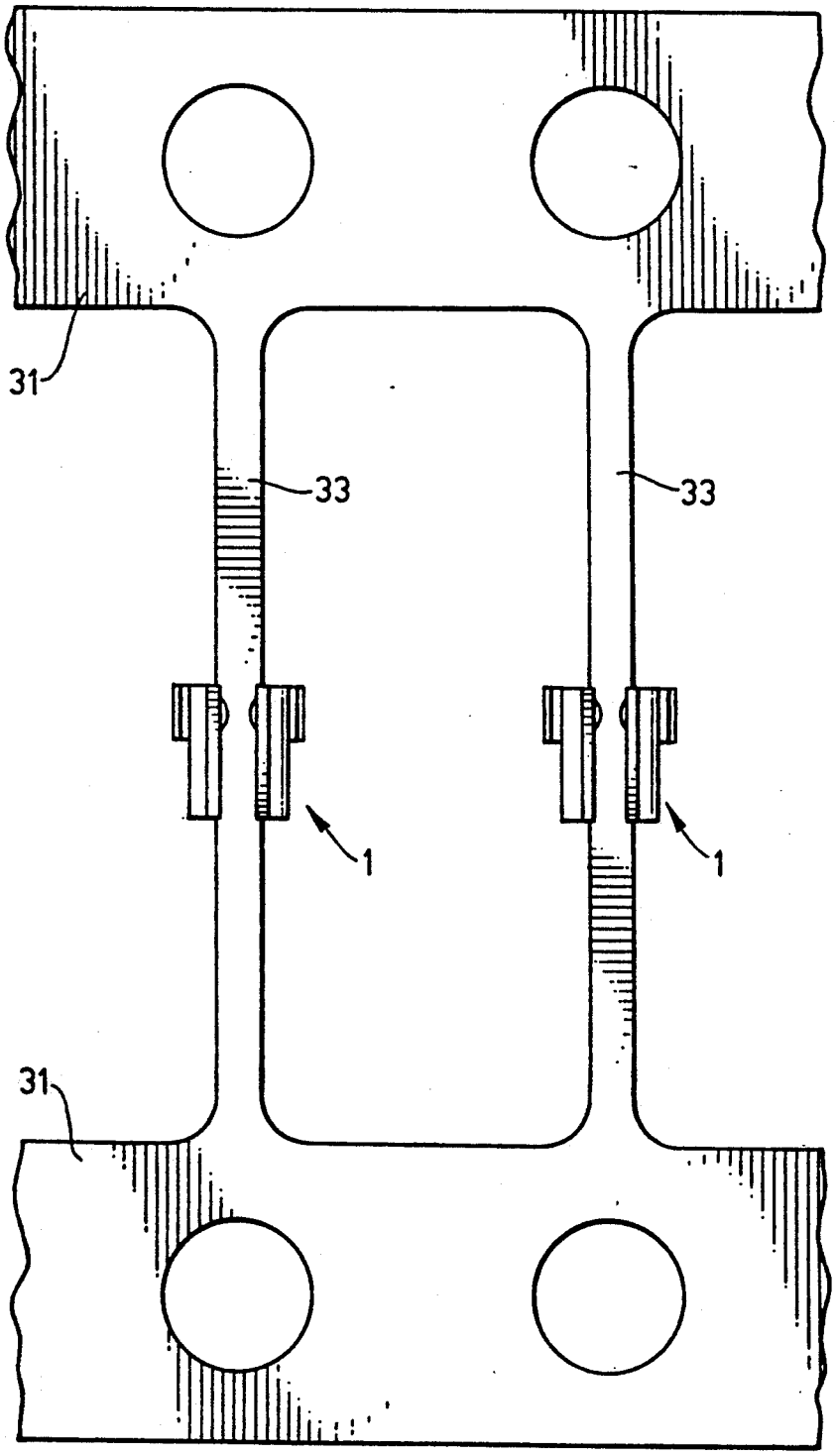
FIG. 15 is a front view of a third alternative embodiment of the present invention in which each end of the body of the inventive contact is elongated and attached to parallel strips.

In yet another alternative embodiment, shown in FIG. 15, a contact 1 is fabricated on a carrier strip 31 with other contacts in a fashion known to those skilled in the art. The body 33 of each contact is elongated and attached to parallel strips at each end thereof.

A number of embodiments of the present invention have been described. Nevertheless, it will be understood that various modifications may be made without departing from the spirit and scope of the invention. Accordingly, it is to be understood that the invention is not to be limited by the specific illustrated embodiment, but only by the scope of the appended claims.

I claim:

1. A low profile dual beam electrical connector contact including:

a) a generally rectangular body having at least two opposed lateral extensions positioned between the distal and proximal ends of the body;

b) at least two cantilevered contact beams which define a length "L", each attached to a corresponding one of the lateral extensions, each contact beam extending from its corresponding lateral extension toward the distal end of the body and angled approximately 90° with respect to the body;

c) a retention flange means for securing the contact in a housing, and attached to the body near the distal end of the body adjacent to and spaced apart from the contact beams;

d) a solder tail means for electrically interconnecting the contact with an electrical component, and attached to the proximal end of the body;

wherein the contact beams, retention flange means, and body are approximately contained within a longitudinal space having length "L".

2. The low profile dual beam electrical connector contact of claim 1, wherein each cantilevered contact beam rotates about at least two perpendicular axes, creating torsional forces, each force being translated to a point near the distal end of each contact beam upon insertion of, and applied to, a male mating pin.

3. The low profile dual beam electrical connector contact of claim 1, wherein the solder tail extends from the body in a direction perpendicular to the length of the body and away from the contact beams.

4. The low profile dual beam electrical connector contact of claim 1, wherein the contact beams are biased in toward each other by a rotation of each contact beam about the line of attachment between each contact beam and the corresponding lateral extension from the body.

5. The low profile dual beam electrical connector contact of claim 1, wherein the contact beams each have a convex contact pad located near the distal end of each contact beam.

6. The low profile dual beam electrical connector contact of claim 5, wherein the retention flanges are on the body and adjacent to the contact pads.

7. The low profile dual beam electrical connector contact of claim 6, wherein the retention means extends from an edge of the body at the distal end thereof.

8. The low profile dual beam electrical connector contact of claim 1, wherein the body and the solder tail are elongated, each attached to one of two carrier strips aligned perpendicular to the length of the body, each carrier strip being parallel to the other.

* * * * *